US006823801B2

(12) United States Patent
Lieberman

(10) Patent No.: US 6,823,801 B2
(45) Date of Patent: Nov. 30, 2004

(54) INFLATABLE SNACK TABLE

(75) Inventor: Marvin S. Lieberman, New York, NY (US)

(73) Assignee: Alvimar Manufacturing Co., Inc., Long Island City, NY (US)

( * ) Notice: Subject to any disclaimer, the term of this patent is extended or adjusted under 35 U.S.C. 154(b) by 0 days.

(21) Appl. No.: 09/916,177

(22) Filed: Jul. 26, 2001

(65) Prior Publication Data

US 2003/0024448 A1 Feb. 6, 2003

(51) Int. Cl.[7] ..... A47B 85/00
(52) U.S. Cl. ..... 108/25
(58) Field of Search ..... 108/43, 44, 25, 108/26; 206/562, 563, 557; D6/406.3, 406.5

(56) References Cited

U.S. PATENT DOCUMENTS 4,117,782 A * 10/1978 Cahill
5,134,930 A * 8/1992 Mei-Hwa
5,623,869 A * 4/1997 Moss et al.
D405,291 S * 2/1999 Yu
6,410,065 B1 * 6/2002 Nottingham et al.

FOREIGN PATENT DOCUMENTS

GB 2173694 A * 10/1986

* cited by examiner

*Primary Examiner*—Jose V. Chen
(74) *Attorney, Agent, or Firm*—Amster, Rothstein & Ebenstein LLP

(57) ABSTRACT

An inflatable snack table formed of heat sealable plastic sheet and shaped as a spherical outer housing, with a base at the bottom and an opening in the top to hold a food container. Within the outer housing is a generally cylindrical inner housing extending between and secured to the top and bottom of the spherical outer housing.

14 Claims, 4 Drawing Sheets

FIG. 1
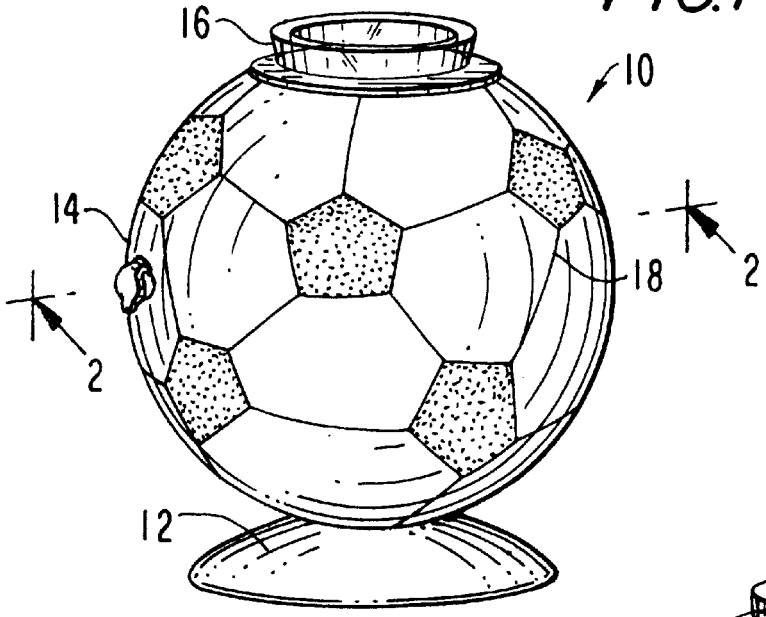
FIG. 1A
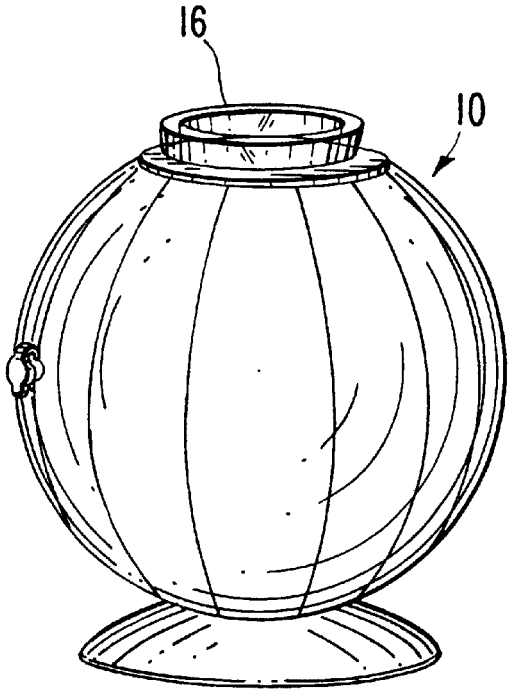
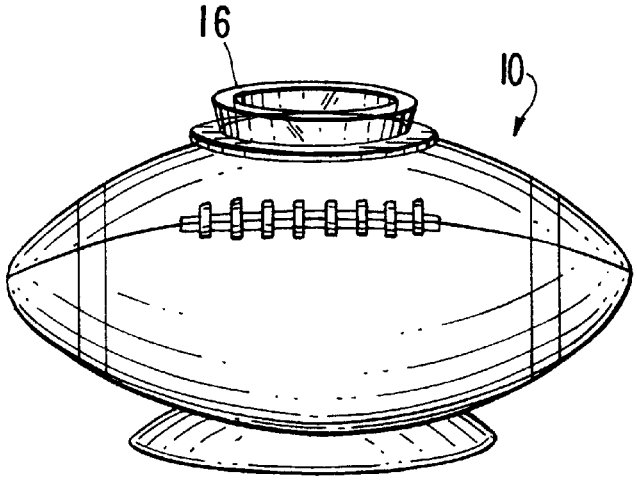
FIG. 1B

INFLATABLE SNACK TABLE

FIELD OF THE INVENTION

This invention is in the field of structures such as small tables for supporting bowls and other containers of snack food. More particularly, the invention pertains to support structures for containers for snack foods which people eat while sitting and watching sporting events on television.

BACKGROUND OF THE INVENTION

It is common for persons watching sporting events on television, while they are sitting on sofas or other reclining chairs, to wish to nibble on snack foods. Especially where there are numerous persons in a living room setting, often there is insufficient space for regular tables to support the bowls of food. Thus, bowls will be placed on the floor or in people's laps or on sofas. It is a nuisance for people to have to reach down to the food bowls on the floor or to have bowls on their laps, and bowls on sofas are susceptible to spilling.

OBJECTS AND SUMMARY OF THE INVENTION

It is a first object of this invention to provide a table-like support structure for bowls containing food so that persons sitting in lounge chairs and watching television can easily reach the food. It is a further object of this invention to provide a table-like support structure which will be convenient to use and will be relatively safe from tipping. Another object is for this container to include a support portion that is elevated from its base on the floor so that the food is easily reachable by a person sitting in a chair without having to reach to the floor. Another object is for this support structure to occupy as little space as possible, since space may be in short supply when numerous chairs are positioned generally together for people to watch a single television screen.

An additional object is that this new structure be not only highly inexpensive, but that it be readily compressible into a small size when not in use. To this end it is a further object that the new table be an inflatable plastic which provides the suitable elevation when inflated to position and support a container of food substantially above the floor, and which occupies essentially no space when it is deflated. It is also an object that this inflatable support be resistant to tipping since it will be somewhat elevated and will be contacted by person's hands from different directions.

Finally, it is an object that this article be attractive and inexpensive.

Additional objects of the invention will be apparent from the following description of the preferred embodiment thereof taken in conjunction with the accompanying non-limiting drawings.

BRIEF DESCRIPTION OF THE DRAWINGS

FIG. 1 is a front perspective view of the new inflatable snack table;

FIG. 1A is similar to FIG. 1 but shows a pumpkin shaped embodiment;

FIG. 1B is similar to FIG. 1 but shows a football shaped embodiment;

DETAILED DESCRIPTION OF THE PREFERRED EMBODIMENT

Figure 2:
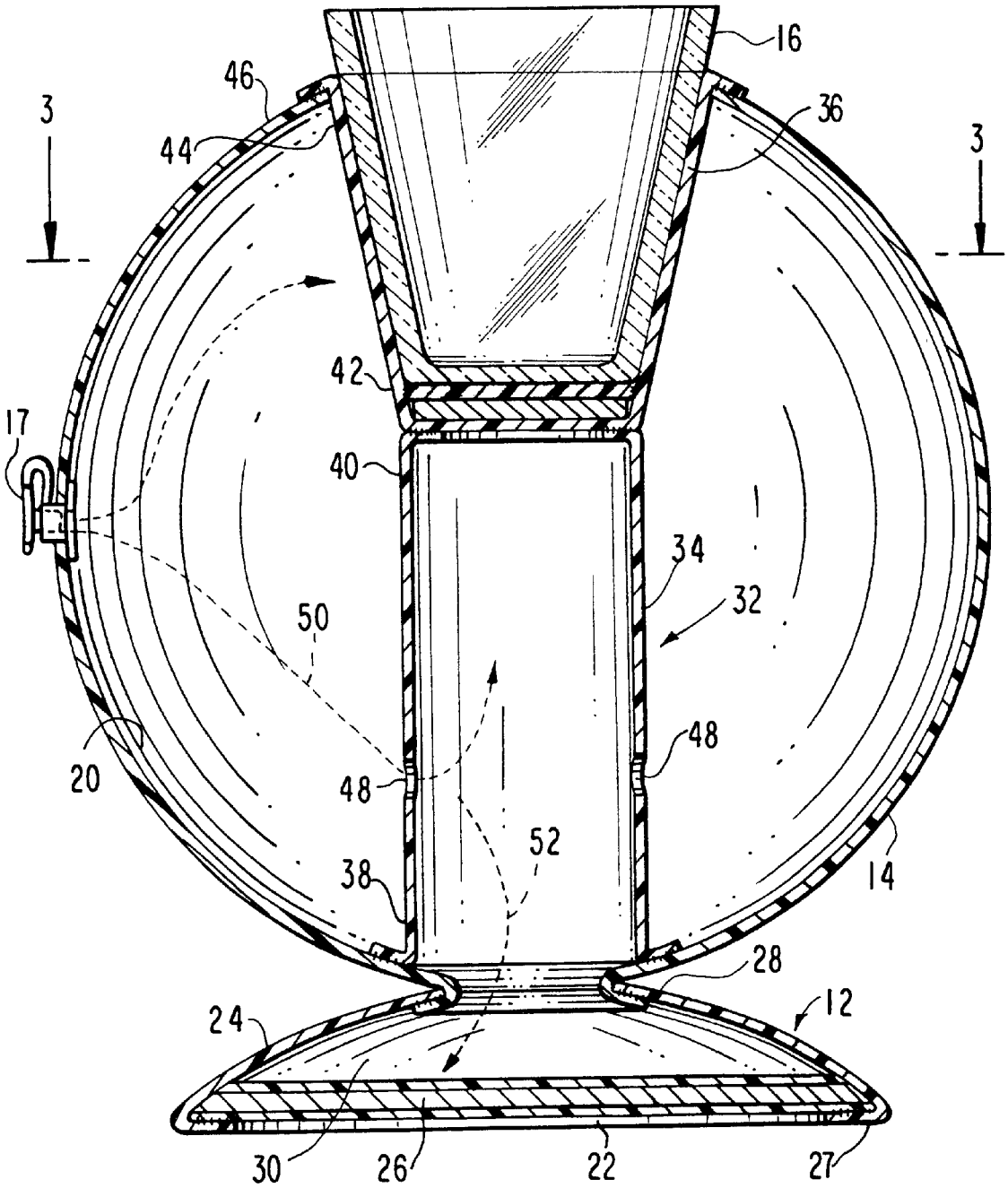
FIG. 2 is a cross-sectional elevation of the new invention taken along lines 2—2 of FIG. 1.

FIG. 1 shows a new inflatable snack table 10 in inflated condition which includes a base 12, an outer housing 14 situated atop the base and a food container 16 situated in the top of the outer housing and extending slightly upward therefrom. Also seen in FIG. 1 is the decorative or ornamental surface 18 on the outer housing which is designed to replicate a soccer ball, in this particular case. Alternatively, this outer surface could replicate a baseball, basketball, football or a pumpkin or other object.

FIG. 2 illustrates more clearly the internal structure of the new invention when in its inflated condition. The outer housing 14, formed of sheet plastic such as polyvinyl chloride and other air-impervious thermoplastics having thickness in the range of 30 mm to 50 mm, has a generally spherical shape which is inherently very strong and stable. Within this outer housing is a primary air chamber 20.

Below the outer housing 14 is the base 12 having a bottom sheet portion 22, a top sheet portion 24, and a stiffening member 26 made of material such as stiff cardboard and locked in position at the bottom of the base by virtue of being trapped between the bottom sheet 22 and the slightly inclined or conical top sheet 24. For manufacturing convenience the top sheet 24 is originally a separate element from the bottom sheet 22, and these elements are joined by well known heat sealing techniques at junction line 27 that extends around the circumference of the base. Also, the top of the upper sheet 12 is heat sealed at junction 28 to the bottom of the spherical outer housing in such a manner that air space 30 within the base is contiguous with the airspace 20 within the outer housing.

Figure 2A:
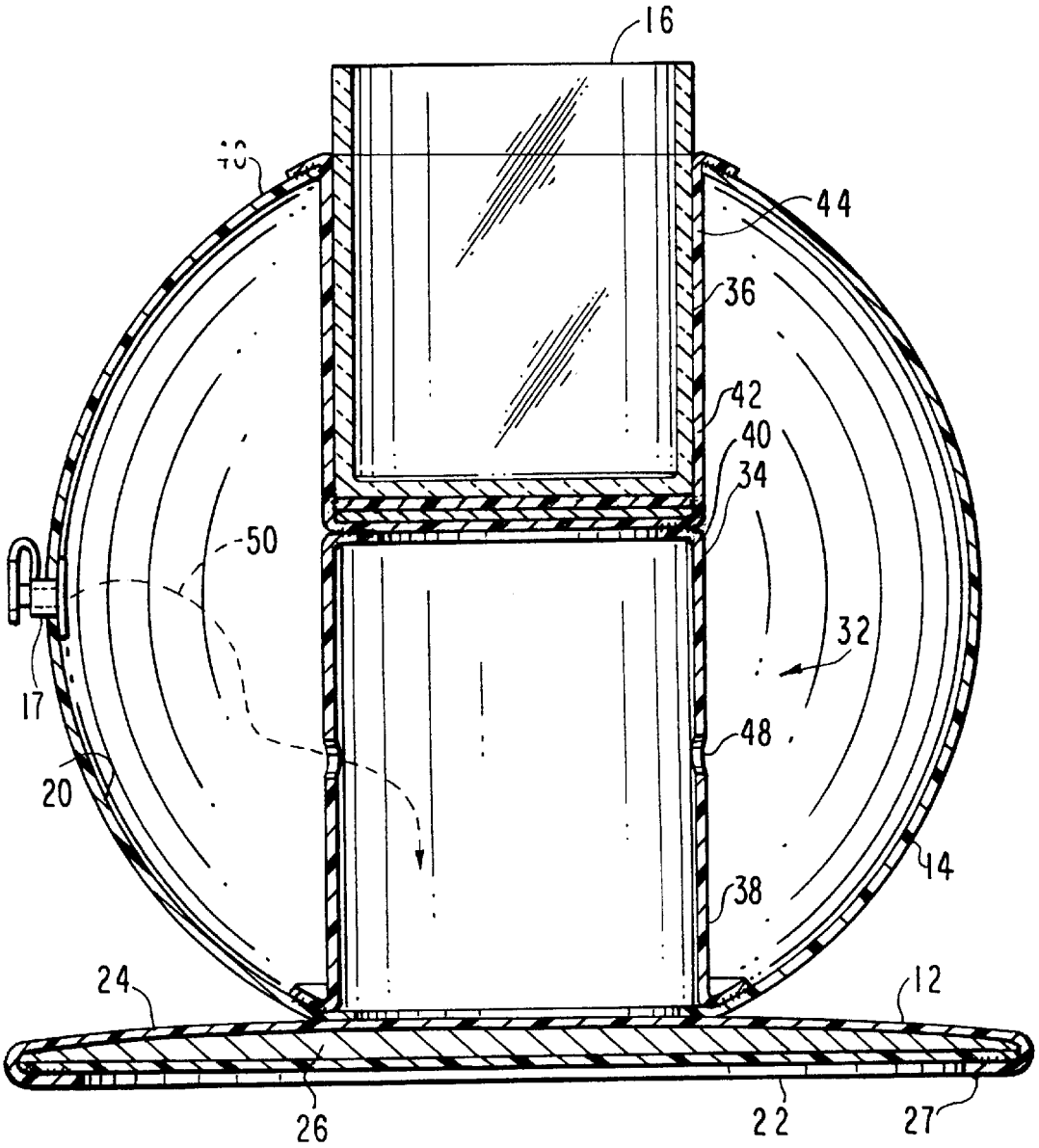
FIG. 2A is similar to FIG. 1 but shows another embodiment.

This base may have various other constructions, including ommission of the airspace 30 such that the top sheet 24 is tight against the stiffening member, or the bottom of the outer housing may be attached directly to a base as seen in FIG. 2A. The base 12 is sufficiently great in diameter to provide adequate stability to stabilize and support the entire structure situated above this base. The stiffening member 26 establishes a flat bottom surface which will not distend and form the base into a convex curve which would be particularly unstable. FIG. 2 is not necessarily to scale, and thus the junction line 28 may be moved radially outward on the base to enhance stability. Also, the diameter of chamber 20 may be enlarged.

Figure 4:
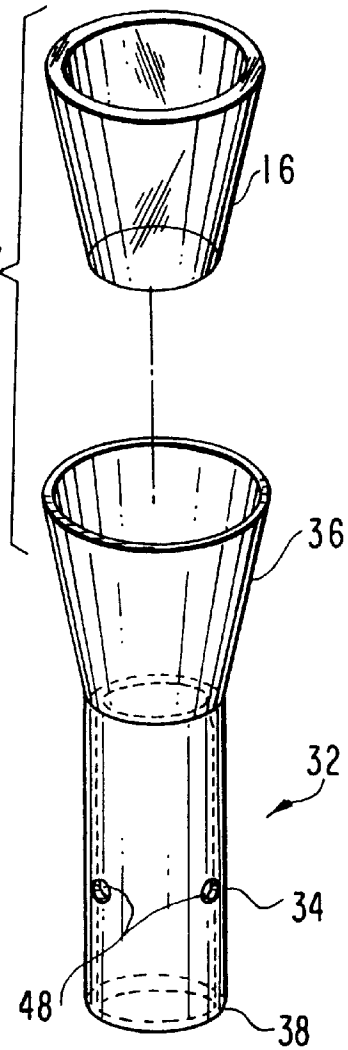
FIG. 4 is an exploded elevation view of the central cylindrical portion of the inflatable snack table viewed independently of the remaining structure

Within the outer housing 14 is a central inner housing 32 formed as a column 34 and a slightly conical chamber 36 situated above the inner housing to support and hold a food container. The inner housing component as seen in both FIGS. 2 and 4 has a lower part formed as a generally straight cylindrical member whose bottom part 38 is heat sealed to or near the junction 28 of the bottom of the outer housing 14 and the top of the base 12. This inner housing has a top part 40 which is heat sealed to the bottom part 42 of the upper chamber 36. Finally, the top part 44 of the upper chamber 36 is heat sealed to the upper circular opening 46 of the outer housing.

Figure 3:
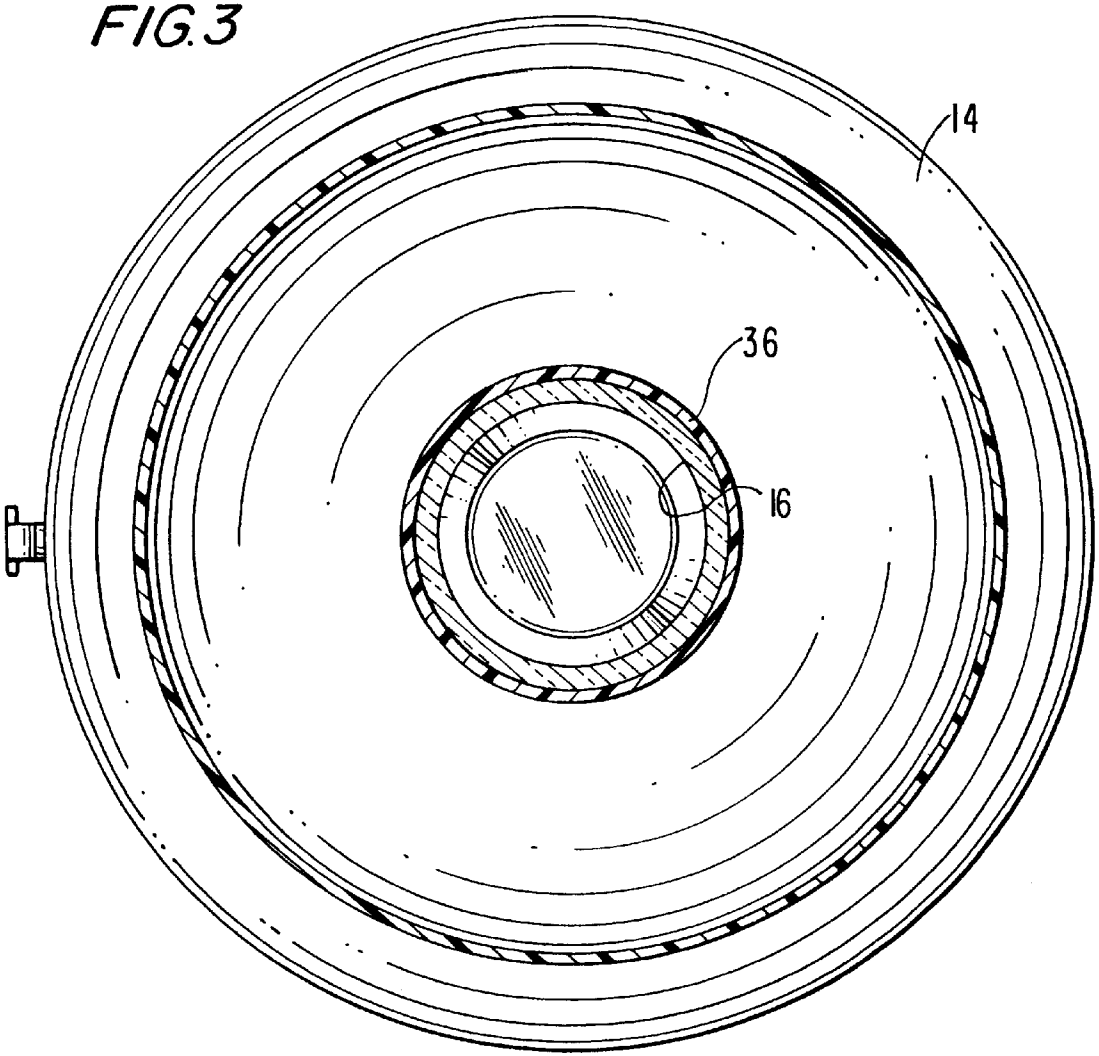
FIG. 3 is a sectional view taken along lines 3—3 in FIG. 2.

The upper chamber 36 is generally conical and diverging in the upward direction so that it can easily receive a similarly shaped food container 16 which will reside securely in the conforming conical shape or truncated cone. The chamber walls could have a number of other profiles including straight cylinder walls as seen in FIG. 2A, so long as they could receive and hold a food container. Preferably, the food container is placed into chamber 36 before the entire structure is inflated, because during inflation the walls of chamber 36 become pressed radially inward against and holding the food container. The base of this upper chamber may be stiffened by a stiffening element which is fixed or removable therefrom. The cross-sectional view of FIG. 3 illustrates the outer housing 14, the upper chamber 36 and the food chamber 16 in their respective concentric positions.

As further seen in FIG. 2 the interior 20 of the outer housing 14 is a generally large spherical air chamber having its central area occupied by the inner housing 32. Approximately midway along the height of the inner housing 32 is an air passage comprising one or more apertures 48 which allow air entering through valve 17 to flow via arrow 50 down into and inflate the base 12. Thus, from one valve 17 the entire inflatable snack table can be readily inflated for use as a food support structure.

The inner housing structure is particularly well suited for strength and stability in that it has a basic cylindrical shape which is inherently stable and strong, which is joined to the cylinder 36 above it whose walls are generally coincident with those of the straight cylinder below. When this inner structure is combined by heat sealing with the spherical outer shape, the entire structure is stabilized from any bending, twisting, or toppling or even rolling. All parts of the outer spherical housing, because of being inflated, are in tension and stabilized from moving in any direction. The inner housing having its lower edges heat sealed to the outer housing is thus similarly stabilized from any transverse or vertical or bending or shifting motion. The same applies to the upper chamber 36 of the inner housing. This new inflatable table has, as a result of this inner and outer structure, a very strong and stable constitution and will be extremely reliable for supporting food whether it is dry or liquid.

Finally, it should be noted that in this preferred embodiment the food is presented in a removable container 16 which can be readily cleaned, and thus the food does not contact the inflatable table structure.

It should be clear that this invention may be fabricated in a variety of other shapes that are not exactly as illustrated. The inner housing might not be a straight cylinder but may take other shapes so long as it extends from a first portion of the outer housing to a generally opposite second portion. For example, FIG. 2 shows the inner housing extending from the bottom to the top of the outer housing. Also, as mentioned earlier, the outer housing does not necessarily have to be a spherical shape; it could have an oval, or football or other shape as seen in FIGS. 1A and 1B. Also, the base does not have to be circular, but could be rectangular or octagonal, etc. Also, the air chambers could be separate instead of one contiguous air chamber as seen; however, for convenience of manufacture and use, the single contiguous air chamber has been shown. Many choices of plastic sheet material are possible among the many commonly available choices. The heat sealing can be done in a variety of well known techniques, and as indicated above, the outer surface of the outer housing can be decorated in a variety of ways.

It should be apparent that this article when deflated will be folded or crumpled into a generally flat or other shape far smaller than the inflated shape.

Although the invention has been described with respect to a preferred embodiment it is understood that changes and modifications can be made which are within the full intended scope of the invention as defined by the appended claims.

What is claimed is:

1. An inflatable snack table formed of plastic sheet comprising when inflated:

(a) an outer housing formed generally as a spherical wall having a circular aperture at its top defining a top edge and a circular aperture at the bottom defining a bottom edge;

(b) a base to which said bottom edge is secured;

(c) an inner housing formed as a cylinder whose walls have top and bottom ends, said bottom end secured to said bottom edge of said outer housing;

(d) an upper chamber formed generally as a cylinder having a closed bottom, side walls, and top edge, said top end of said inner housing being secured to said bottom of said upper chamber, said top edge of said upper chamber being secured to said top edge of said outer housing, said outer housing being inflatable such that it stands upright on said base, and said upper chamber is open at the top and is adapted to receive and hold a cylindrical container, and (e) a valve in said spherical wall of said outer housing for inflating said outer and inner housing.

2. An inflatable snack table according to claim 1 wherein said outer housing defines within its spherical walls a principal space, and said inner housing defines within its cylindrical wall a secondary space, and said cylindrical wall of said inner housing includes at least one aperture therethrough to allow air flow from said principal space into said secondary space.

3. An inflatable snack table according to claim 1 wherein said base comprises a top and a bottom sheet forming an envelope, a stiffening element situated between said top and bottom sheets, said top sheet being secured to said bottom edge of said outer housing.

4. An inflatable snack table according to claim 3 wherein said top and bottom sheets define a chamber which communicates internally with said outer housing and is thereby inflatable when said outer housing is inflated.

5. An inflatable snack table according to claim 1 wherein said upper chamber is generally truncated cone having a flat bottom and diverging walls in the upward direction.

6. An inflatable snack table according to claim 1 wherein said inner housing extends lengthwise in the upper direction at least half the height of the spherical outer housing.

7. An inflatable snack table according to claim 1 wherein said base has a diameter generally the same as the diameter of said outer housing.

8. An inflatable snack table according to claim 1 wherein said upper chamber further comprises a stiffening element situated at its closed bottom.

9. An inflatable snack table according to claim 8 wherein said stiffening element is cardboard secured within an envelope of plastic sheet material.

10. An inflatable snack table formed of plastic sheet comprising when inflated:

(a) an outer housing formed as a wall having an aperture at its top defining a top edge and a bottom;

(b) a base to which said bottom is secured;

(c) an inner housing formed as a cylinder whose walls have top and bottom ends, said bottom end secured to said bottom of said outer housing;

(d) an upper chamber formed generally as a cylinder having a closed bottom, side walls, and top edge, and (e) a valve in said wall of said outer housing, said top end of said inner housing being secured to said bottom of said upper chamber, said top edge of said upper chamber being secured to said top edge of said outer housing, said outer housing being inflatable such that it stands upright on said base, and said upper chamber is open at the top and is adapted to receive and hold a container.

11. An inflatable snack table according to claim 10 wherein said outer housing has a shape which replicates a football.

12. An inflatable snack table according to claim 10 wherein said outer housing has a shape which replicates a basketball.

13. An inflatable snack table according to claim 10 wherein said outer housing has a shape which replicates a pumpkin.

14. An inflatable snack table according to claim 10 wherein said upper chamber is formed as a generally straight cylinder.

* * * * *